US006189607B1

(12) United States Patent
Hosoya et al.

(10) Patent No.: US 6,189,607 B1
(45) Date of Patent: Feb. 20, 2001

(54) HEAT EXCHANGER

(76) Inventors: Kazuki Hosoya; Toshiharu Shinmura; Hirotaka Kado; Akira Sakano, all of c/o Sanden Corporation, 20 Kotobuki-cho, Isesaki-shi, Gunma, 372-8502 (JP)

( * ) Notice: Under 35 U.S.C. 154(b), the term of this patent shall be extended for 0 days.

(21) Appl. No.: 09/359,435

(22) Filed: Jul. 22, 1999

(30) Foreign Application Priority Data

| | | |
|---|---|---|
| Jul. 31, 1998 | (JP) | 10-216999 |
| Aug. 4, 1998 | (JP) | 10-219968 |
| Jul. 7, 1999 | (JP) | 11-192950 |
| Jul. 7, 1999 | (JP) | 11-193018 |

(51) Int. Cl.[7] ..... F28F 9/02

(52) U.S. Cl. ..... 165/174; 175/109.1; 175/177; 175/173; 175/181; 175/183

(58) Field of Search ..... 165/153, 110, 165/173, 109.1, 174, 175, 177, 178, 181, 183

(56) References Cited

U.S. PATENT DOCUMENTS

| | | | | |
|---|---|---|---|---|
| 4,202,182 | * | 5/1980 | Kawashima et al. | 165/174 X |
| 5,025,855 | * | 6/1991 | Hoshino et al. | 165/174 X |
| 5,076,354 | * | 12/1991 | Nishishita | 165/174 X |
| 5,184,672 | * | 2/1993 | Aoki | 165/109.1 |
| 5,186,249 | * | 2/1993 | Bhatti et al. | 165/174 |
| 5,329,994 | * | 7/1994 | Collings et al. | 165/109.1 |
| 5,441,106 | * | 8/1995 | Yukitake | 165/117 X |
| 5,458,190 | * | 10/1995 | Sasaki et al. | 165/174 X |
| 5,586,598 | * | 12/1996 | Tanaka et al. | 165/177 X |
| 5,941,303 | * | 9/1999 | Gowan et al. | 165/176 |
| 6,000,467 | * | 12/1999 | Tokizaki et al. | 165/177 X |
| 6,056,047 | * | 5/2000 | Gowan | 165/174 |
| 6,062,303 | * | 5/2000 | Ahn et al. | 165/174 X |

FOREIGN PATENT DOCUMENTS

| | | |
|---|---|---|
| 58-140597 | 8/1983 | (JP) . |
| 9196594 | 7/1997 | (JP) . |

* cited by examiner

*Primary Examiner*—Christopher Atkinson
(74) *Attorney, Agent, or Firm*—Baker Botts L.L.P.

(57) ABSTRACT

A multi-flow type heat exchanger includes a pair of headers and a plurality of heat transfer tubes interconnecting the headers. The flow direction of the heat exchange medium through the whole of the heat transfer tubes is only one direction. A flow division parameter $\gamma$ is defined as a ratio of a resistance parameter $\beta$ of the heat transfer tubes to a resistance parameter $\alpha$ of an entrance side header and is set to at least about 0.5. The flow division parameter is calculated, such that $\gamma=\beta/\alpha$, where $\beta=Lt/(Dt \cdot n)$, and $\alpha=Lh/Dh$. The equation variables are defined as follows: Lt equals a length of each tube, Dt equals a hydraulic diameter of one tube, n equals a number of tubes, Lh equals a length of an entrance side header, and Dh equals a hydraulic diameter of the header. The flow division from the header to the tubes may be chosen at an optimum condition, and the heat exchanger may have superior performance.

51 Claims, 7 Drawing Sheets

HEAT EXCHANGER

BACKGROUND OF THE INVENTION

1. Field of the Invention

The present invention relates to a heat exchanger including a pair of headers and a plurality of parallel heat transfer tubes interconnecting the headers, and, more specifically, to a heat exchanger which is suitable for use in a vehicle air conditioner and which may achieve uniform distribution of a heat exchange medium.

2. Description of Related Art

In recent vehicle air conditioner configurations, particular condensers and evaporators have been employed to attain a heat exchanger which experience low pressure loss, and are capable of increasing the efficiency of heat exchange, but which facilitate manufacture of the air conditioner. In the field of condensers, so-called multi-flow type condensers, interconnecting a pair of header pipes with a plurality flat tubes, have been mainly employed. In the field of evaporators, stacking-type evaporators, consisting of a straight or U-shaped refrigerant path between a pair of header tanks, wherein such path is created by stacking a plurality of tubes formed by joining pairs of molded plates, have been mainly employed.

In a heat exchanger having headers, such as the above-described multi-flow type condenser or stacking-type evaporator, the pressure applied to each tube is first determined by the pressure gradient of refrigerant in an entrance side header, and the amount of refrigerant flowing into each tube is then determined by the degree of the refrigerant pressure in the header. Namely, in the header, the pressure near the refrigerant inlet portion of the header is highest, and the pressure gradually decreases as the distance from the inlet portion increases. Therefore, a large amount of refrigerant flows in the tubes near the refrigerant inlet portion, and the amount of refrigerant distributed to the tubes far from the refrigerant inlet portion is likely to be inadequate. Consequently, an area of inadequate refrigerant flow may be generated over the entire core portion of each of the above-described heat exchangers, and, as a result, the temperature distribution across the heat exchanger may become nonuniform and the efficiency of heat exchange may decrease.

In the case of a condenser, the condenser is positioned in front of an engine compartment of a vehicle, and the heat exchange is performed by introducing air for the heat exchange from a front grill of the vehicle. However, the opening area of the grill generally is not designed to be sufficiently large as compared with the area of the core portion of the condenser, to introduce air for heat exchange over the entire area of the core portion. Moreover, the introduction of air for heat exchange is further restricted by a bumper and a number plate. Under such conditions, a sufficient amount of air for heat exchange may be distributed only to a part of the entire core portion. Consequently, the entire core portion may not function for heat exchange at a high efficiency, and the efficiency of the heat exchanger may be reduced.

In the case of an evaporator, because generally a connecting portion is formed between a blower unit and an evaporator unit and both units are connected thereon; as in the case of a condenser, a sufficient amount of air for heat exchange may be distributed only to a part of the entire core portion of the evaporator. Consequently, the entire core portion may not function for heat exchange at a high efficiency, and the efficiency of the heat exchanger may be reduced.

In such conventional heat exchangers, in order to compensate for the reduced heat exchange performance due to deficiencies in the heat exchangers themselves and due to the problems caused by their location on a vehicle, partitions are provided in the headers, and thereby, refrigerant flow is divided in multiple paths in a heat exchanger, such as three paths or four paths, so that the refrigerant may comes into repeated contact with air passing through the heat exchanger.

Further, except the above-described multiple path structure formed by partitions, various structures for increasing the heat exchange performance, particularly, for improving the division of refrigerant flow in a heat exchanger, have been proposed.

For example, JP-A-58-140597 proposes to incline an inner fin in a heat transfer tube and lower the temperature difference between refrigerant in air entrance side and refrigerant in air exit side of a heat exchanger, thereby improving the heat transfer performance.

JP-A-9-196595 describes the insertion of a refrigerant introducing pipe into a header at a great depth, the pipe including refrigerant passing holes in the pipe for dividing a part of the flow of the refrigerant in the header. Consequently, the flow dividing condition is more uniform in the heat exchanger, and the cooling temperature is more uniform.

In the improvement due to the above-described multiple path structure, however, because at least two or three partitions are required, the cost for the material and the manufacture may increase, and the insertion hole processing for inserting the partitions into a header pipe or a header tank may be difficult.

Moreover, very difficult working and complicated designing are required to set the positions of the insertion holes, because the respective numbers of refrigerant tubes in the respective tube groups are divided by the partitions and the ratio of tube groups to partitions must be determined to be optimum, so that the efficiency for heat exchange may increase and refrigerant may flow more uniformly.

In the improvement of the above-described JP-A-58-140597 or JP-A-9-196595, although both propose to make the flow division in the heat exchanger more uniform, JP-A-58-140597 proposes accomplishing this only with the improvement of heat transfer tubes, and JP-A-9-196595 proposes accomplishing this only with the improvement of header portions.

Accordingly, the improvements of the above-described references have been examined by conducting tests only on tubes (corresponding to the heat transfer tubes described above) and only on headers, using those having shapes similar to the shapes proposed in the above-described references. As a result, although a slight improvement could be observed, a satisfactory result was not obtained.

Namely, as aforementioned, the amount of refrigerant flowing into each tube is determined by the pressure gradient of refrigerant in a header, in other words, by the degree of the refrigerant pressure in the header. Because the pressure near the refrigerant inlet portion of the header is highest and the pressure gradually decreases with the distance from the inlet portion, refrigerant flows in large amounts in the tubes near the refrigerant inlet portion, and the amount of refrigerant distributed to the tubes far from the refrigerant inlet portion is likely to be inadequate. Consequently, the flow division deteriorates, and the efficiency of heat exchange decreases. Satisfactory flow division and high efficiency for heat exchange are not achieved, so long as the essential problem of nonuniform flow division and decreased efficiency of heat exchange originating from the pressure distribution in the header, is not solved.

SUMMARY OF THE INVENTION

Accordingly, if the pressure distribution of refrigerant in a header was made as uniform as possible, a satisfactory flow division could be obtained. The present invention has been achieved from such a viewpoint.

The present invention recognizes that the flow division in a heat exchanger depends not only on only tubes or on only a header, but also on the combination of tubes and a header, especially, the relationship between and the action of both of (a) the path resistance (degree of difficulty to flow) represented by a hydraulic diameter of the refrigerant path affecting the flow resistance of refrigerant in a tube and the length of a tube, and (b) the pressure of refrigerant in a header. In order to improve the flow division in the heat exchanger, a new causal relationship between the refrigerant pressure in tubes and the refrigerant pressure in a header has been found, that improves the flow division, not by the method for providing many partitions in the header and forming multiple paths for the refrigerant flow, which succeeds in finding an optimum causal relationship and expressing it as a numeric value.

Further, in the present invention, a heat transfer tube itself, in particular, its interior structure, has also been investigated.

Namely, a heat transfer tube having therein a plurality of small divided paths extending in the longitudinal direction of the tube has been known, wherein a waving inner fin is provided in the tube, or wherein the tube is formed by extrusion molding, so that the interior of the tube is divided by a plurality of partition walls.

In a heat exchanger having the heat transfer tubes with such small paths, for example, in a situation in which a heat medium flowing in the tubes is a refrigerant, the temperature difference between the temperature of refrigerant flowing in the path positioned on the air entrance side of the tube in the heat exchanger and the temperature of air passing through the outside thereof, becomes greater than the temperature difference between the temperature of refrigerant flowing in the path positioned on the air exit side in the transverse direction of the tube and the temperature of air passing through the outside thereof. Therefore, the heat transfer on the air entrance side is superior to the heat transfer on the air exit side. As a result, refrigerant flowing in the path on the air entrance side is condensed more greatly, the ratio of the liquid component to the gaseous component in the refrigerant increases and the specific gravity of the refrigerant also increases, and the flow speed of the refrigerant becomes slow. On the other hand, refrigerant flowing in the path on the air exit side is not accelerated in condensation, the ratio of the gaseous component to the liquid component is maintained at a high level, and the specific gravity of the refrigerant is maintained at a low amount, and the flow speed of the refrigerant increases. Therefore, in a single heat transfer tube, there occurs a difference of heat transfer in its transverse direction, i.e., in the air passing direction, and the efficiency of heat transfer as the whole of the heat exchanger may be reduced.

Accordingly, in consideration of the above-described problem that the flow division deteriorates as a result of the relationship between the refrigerant pressure in tubes and the refrigerant pressure in a header, it is an object of the present invention to provide an improved heat exchanger which suppresses the flow of refrigerant (the heat exchange medium) to one path or two paths by providing no partition in a header or providing only one partition that is a minimum number, while achieving an optimum flow division of refrigerant and superior heat exchange performance.

It is another object of the present invention to provide an improved heat exchanger, particularly, an improved heat exchanger having tubes with inner fins, which may increase the efficiency of heat transfer as a whole, thereby improving its heat exchange performance.

To achieve the foregoing and other objects, the structure of a heat exchanger according to the present invention is herein described. The heat exchanger, such as a multi-flow type heat exchanger, includes a pair of headers, and a plurality of heat transfer tubes interconnecting the pair of headers, and in which the flow of heat exchange medium through the whole of the plurality of heat transfer tubes is only in one direction. In the improvement, a flow division parameter $\gamma$, defined as a ratio of a resistance parameter $\beta$ of the plurality of heat transfer tubes to a resistance parameter $\alpha$ of a header located on the entrance side of the heat exchange medium, is at least about 0.5.

The flow division parameter is calculated, such that $$\gamma=\beta/\alpha,$$

where $$\beta=Lt/(Dt\cdot n),$$

and $$\alpha=Lh/Dh;$$

and where the equation variables are defined as follows:

Lt: length of tube,

Dt: hydraulic diameter of one tube, n: number of tubes,

Lh: length of the header located on the entrance side of the heat exchange medium, and Dh: hydraulic diameter of the header located on the entrance side of the heat exchange medium.

The flow division parameter $\gamma$ is preferably in the range of about 0.5 to about 1.5.

Further, a heat exchanger according to the present invention, such as a multi-flow type heat exchanger, includes a pair of headers, and a plurality of heat transfer tubes interconnecting the pair of headers, and in which the flow of heat exchange medium through the whole of the plurality of heat transfer tubes is in two directions: a first direction for a part of the plurality of heat transfer tubes and a second direction for the remaining heat transfer tubes. In the improvement, a flow division parameter $\gamma 1$ is defined as a ratio of a resistance parameter $\beta 1$ of the part of the plurality of heat transfer tubes to a resistance parameter $\alpha 1$ of a first header portion located on the entrance side of the heat exchange medium relative to the heat transfer tubes with respect to the heat exchange medium flowing in the first direction is at least about 0.5.

The flow division parameter is calculated, such that $$\gamma 1=\beta/\alpha 1,$$

where $$\beta 1=Lt/(Dt\cdot n\mathbf{1}),$$

and $$\alpha 1=Lh\mathbf{1}/Dh\mathbf{1};$$

and where the equation variables are defined as follows:

Lt: length of tube,

Dt: hydraulic diameter of one tube, n1: number of tubes flowing the heat exchange medium in the first direction, Lh1: length of first header portion, and Dh1: hydraulic diameter of first header portion.

In this heat exchanger, it is preferred that a flow division parameter $\gamma 2$, defined as a ratio of a resistance parameter $\beta 2$ of the remaining heat transfer tubes to a resistance parameter $\alpha 2$ of a second header portion located on the entrance side of the heat exchange medium relative to the remaining heat transfer tubes flowing the heat exchange medium in the second direction is at least about 0.5.

The flow division parameter is calculated, such that $$\gamma 2=\beta 2/\alpha 2,$$

where $$\beta 2=Lt/(Dt\cdot n2),$$

and $$\alpha 2=Lh2/Dh2;$$

and where the equation variables are defined as follows:

Lt: length of tube,

Dt: hydraulic diameter of one tube, n2: number of tubes flowing the heat exchange medium in the second direction, Lh2: length of second header portion, and Dh2: hydraulic diameter of second header portion.

In this structure, at least one of the flow division parameters $\gamma 1$ and $\gamma 2$ is preferably in the range of about 0.5 to about 1.5. More preferably, the flow division parameter $\gamma 1$ is in the range of about 0.5 to about 1.5, and the flow division parameter $\gamma 2$ is in the range of about 0.5 to about 1.5.

In the heat exchanger according to the present invention, the relationship between the pressure in the header and the pressure in the heat transfer tubes, for example, refrigerant tubes (particularly, the resistance of the tubes) may be adjusted to a desired relationship via the flow division parameter $\gamma$, $\gamma 1$ and $\gamma 2$. By this adjustment, the flow resistance of the tube path increases, refrigerant may be prevented from flowing in large amounts into the tubes connected to the header at its refrigerant inlet the portion having the highest pressure, and refrigerant may be retained more uniformly in the header. As a result, the refrigerant pressure in the header may be made more uniform, the pressure applied to the respective tubes may be made more uniform to achieve a good flow division, and a superior heat exchange property may be achieved over the entire core portion of the heat exchanger.

Moreover, in the present invention, because the flow path of the heat medium may be one path or two paths, it is not necessary to provide many partitions in a header as in the known multiple path structures, and the manufacture and the assembly may be further facilitated.

In order to set the above-described flow division parameters $\gamma$, $\gamma 1$, and $\gamma 2$ within the desired ranges, the mutual relationship between the pressure in the header and the resistance of the tubes must be in the predetermined relationship. It is particularly effective to design a structure in which the tubes have a relatively great resistance while refrigerant flows in the tubes, without generating a great temperature distribution. To make each tube have a relatively great resistance, it is effective to use a tube structure dividing the interior of the tube into a plurality of short paths.

In order to set the flow division parameters $\gamma$, $\gamma 1$, and $\gamma 2$ within the respective target ranges desired in the present invention, it is possible to employ a structure in which the interior of the tube is divided merely into a plurality of straight paths, for example, a tube structure in which the plurality of small paths are formed, so that the small paths extend in the longitudinal direction of the tube separatedly from each other. Such tubes may be manufactured by extrusion molding or drawing molding. However, in order to further suppress the temperature difference in the tube, it is more preferable to use a tube structure in which a plurality of paths are formed in each heat transfer tube and the paths allow the heat exchange medium to flow substantially freely in the longitudinal and transverse directions of each tube. Such a plurality of paths may be formed by an inner fin or protruded portions provided on an inner surface of the tube.

In the configuration in which the plurality of paths in the tube are formed by an inner fin, the inner fin is preferably formed such that a plurality of raised portions and depressed portions are formed in a flat plate by slotting and bending the flat plate, a plurality of waving strips, each having a raised portion, a first flat portion, a depressed portion, and a second flat portion formed repeatedly in this order are arranged adjacent to each other, and the first flat portion of one waving strip and the second flat portion of the other waving strip adjacent to the one waving strip form a continuous flat portion.

The waving strips may extend in the longitudinal direction of each tube, and the continuous flat portion may extend in the transverse direction of the tube. Alternatively, the waving strips may extend in the transverse direction of each tube, and the continuous flat portion may extend in the longitudinal direction of the tube. Such waving strips may be formed by roll bending processing of the flat plate.

In the configuration in which the plurality of paths in the tube are formed by protruded portions provided on an inner surface of the tube, the protruded portions may be formed by embossing a wall of the tube.

Further, the tube structure may be formed, such that a plurality of small paths are separated from each other and extend in a tube in its longitudinal direction, for example, in a tube molded by extrusion. In this situation, the flow division parameter $\gamma$ is preferably at least about 0.9, more preferably at least about 1.0. Similarly, the parameter $\gamma 1$ is preferably at least about 0.9, more preferably at least about 1.0. Further, the parameter $\gamma 2$ is preferably at least about 0.9, more preferably at least about 1.0.

The present invention may be applied in both the situation in which the heat exchange medium is refrigerant and the heat exchanger is a condenser and the configuration in which the heat exchange medium is refrigerant and the heat exchanger is an evaporator.

In particular, by using tubes each having the inner fin with the above-described waving strips, it is possible to design the flow division parameters $\gamma$, $\gamma 1$, and $\gamma 2$ within the target ranges, as well as to improve the performance of the tube, and ultimately, the whole of the heat exchanger.

Namely, in the tube having the inner fin with the above-described waving strips, because many raised portions and depressed portions are are formed in a flat plate by slotting and bending, at the positions of the raised portions and depressed portions, holes communicating both surface sides of the flat plate are formed, respectively. When viewed in a direction perpendicular to the direction in which the waving strips extend, the waving strips are arranged, so that the first flat portion of one waving strip and the second flat portion of the adjacent waving strip form a continuous flat portion, and so that the raised portion of one waving strip and the depressed portion of the adjacent waving strip are adjacent to each other.

Therefore, when the heat medium, for example, refrigerant, flows in the waving strip extending direction, the flow is distributed in the right and left directions at each raised portion of each waving strip, and a part of the distributed flow is directed into a depressed portion, directed into a portion on the opposite surface side of the inner fin through a communication hole formed by slotting for forming the raised or depressed portion, or directed to the next raised portion of the adjacent waving portion and thereon distributed again in the right and left directions. Namely, distributing and joining of the flow may be repeated, a plurality of mixing actions may be performed in many portions in the tube. By these mixing actions, a dispersion of the degree of the progress of condensation of refrigerant in the tube may be greatly reduced, and a difference in heat transfer in the transverse direction of the tube, i.e., in the outside air passing direction, is substantially eliminated. As the result of achieving a more uniform heat transfer performance in the transverse direction of the tube, the heat exchange performance of the entire tubes may increase, and the heat exchange performance of the heat exchanger, as a whole, may increase.

Also in the configuration in which refrigerant flows in a direction perpendicular to the waving strip extending direction, because the refrigerant may flow freely into the both surface sides of the inner fin through the communication holes formed by processing of the raised and depressed portions, and because these communication holes are arranged in a staggered layout, the mixing of refrigerant in the tube may be performed effectively. As a result, a more uniform heat transfer in the transverse direction of the tube may be achieved, the heat exchange performance of the entire tubes may increase, and the heat exchange performance of the heat exchanger, as a whole, may increase.

Further objects, features, and advantages of the present invention will be understood from the following detailed description of preferred embodiments of the present invention with reference to the accompanying figures.

BRIEF DESCRIPTION OF THE DRAWINGS

Embodiments of the invention are now described with reference to the accompanying figures, which are given by way of example only, and are not intended to limit the present invention.

DETAILED DESCRIPTION OF PREFERRED EMBODIMENTS

Figure 1:
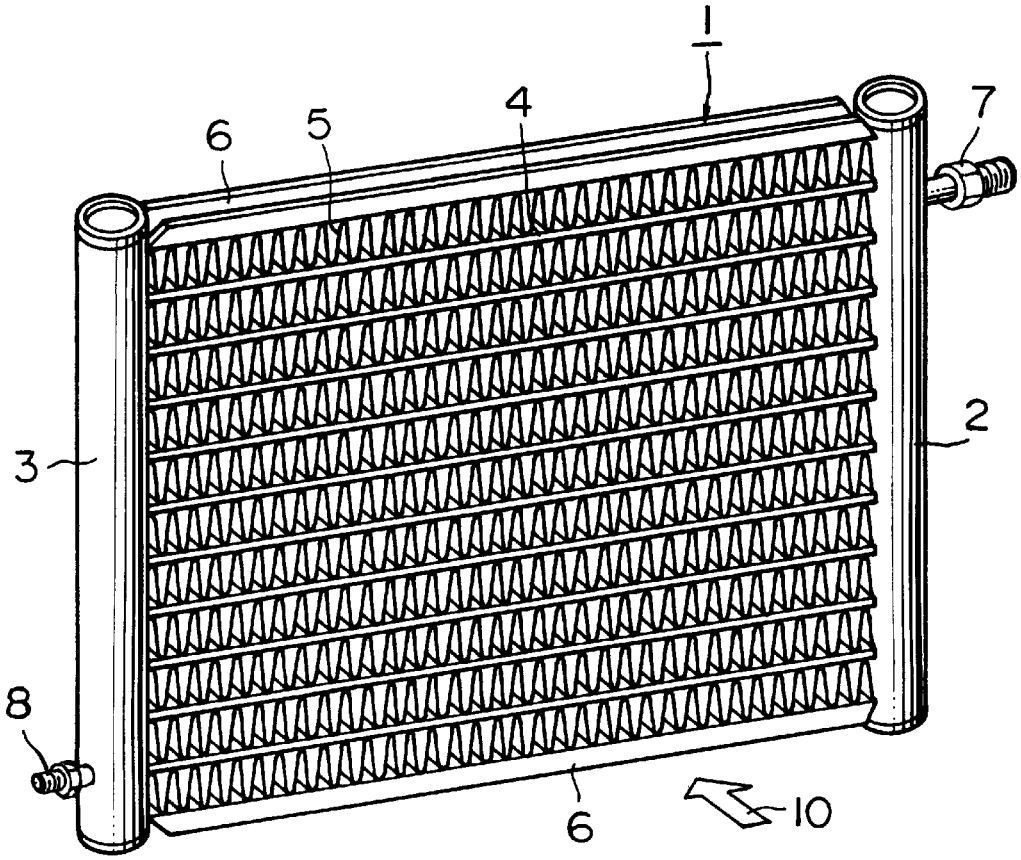
FIG. 1 is a perspective view of a heat exchanger according to a first embodiment of the present invention.

Referring to FIGS. 1 to 4, a heat exchanger, specifically, a condenser, such as a multi-flow type heat exchanger, according to a first embodiment of the present invention is provided. In FIG. 1, condenser 1 includes a pair of headers 2, 3 disposed in parallel to each other. A plurality of heat transfer tubes 4 disposed in parallel to each other with a predetermined interval (for example, flat-type refrigerant tubes). Tubes 4 fluidly interconnect the pair of headers 2, 3. Corrugated fins 5 are interposed between the respective adjacent heat transfer tubes 4 and outside of the outermost heat transfer tubes 4 as outermost fins. Side plates 6 are provided on outermost fins 5, respectively.

Inlet pipe 7 for introducing refrigerant into condenser 1 through entrance side header 2 is provided on the upper portion of header 2. Outlet pipe 8 for removing refrigerant from condenser 1 through exit side header 3 is provided on the lower portion of header 3. The flow direction of refrigerant flowing in the whole of heat transfer tubes 4 disposed between headers 2 and is set in only one direction, i.e., directed from header 2 to header 3, and thus, one flow path is formed. Arrow 10 shows an air flow direction.

Figure 2:
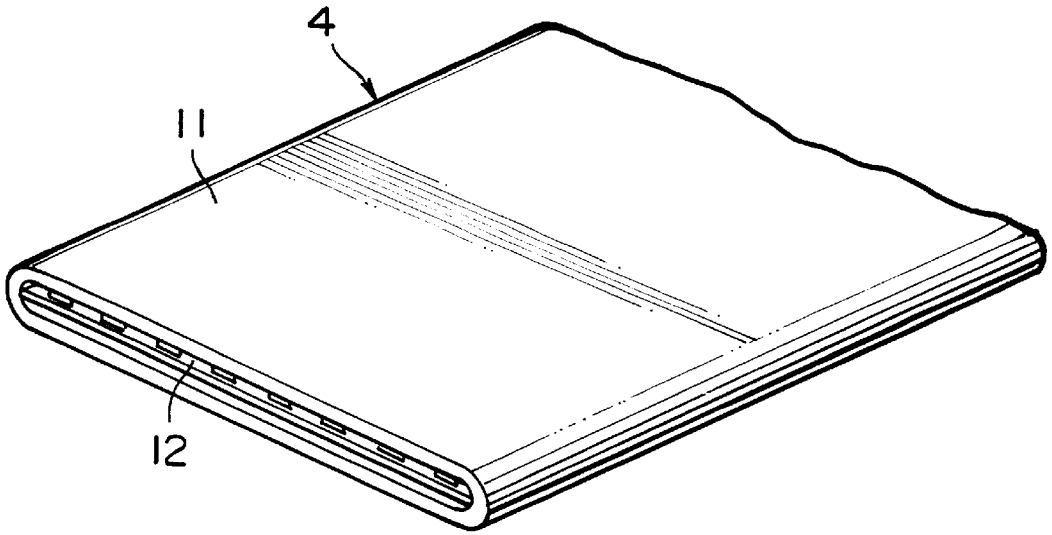
FIG. 2 is an enlarged, partial perspective view of a heat transfer tube of the heat exchanger depicted in FIG. 1.
Figure 3:
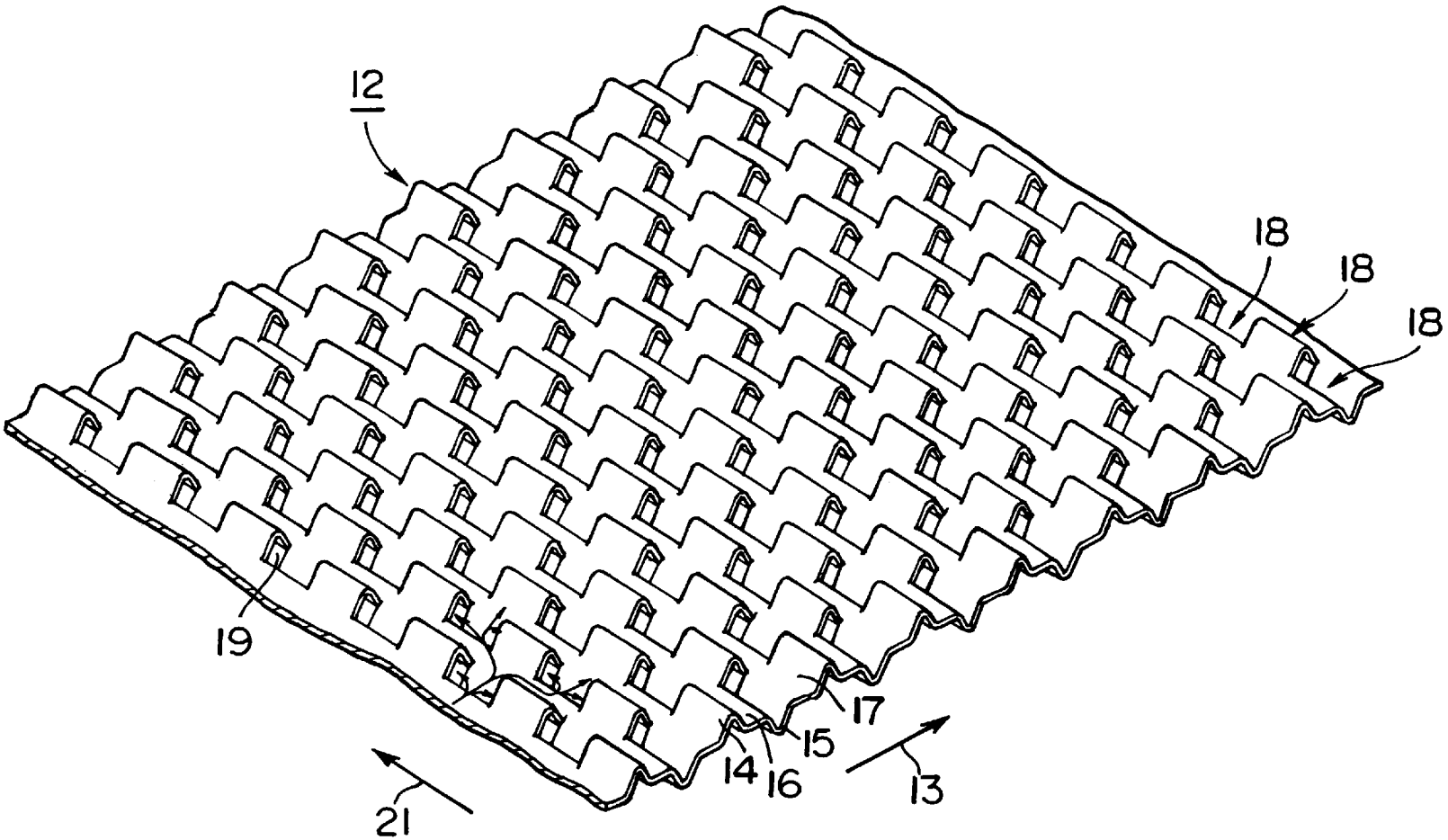
FIG. 3 is an enlarged, partial perspective view of an inner fin provided in the tube as depicted in FIG. 2.
Figure 4:
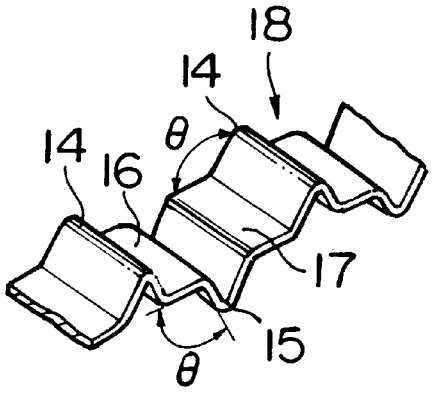
FIG. 4 is an enlarged, partial perspective view of the inner fin as depicted in FIG. 3.
Figure 5:
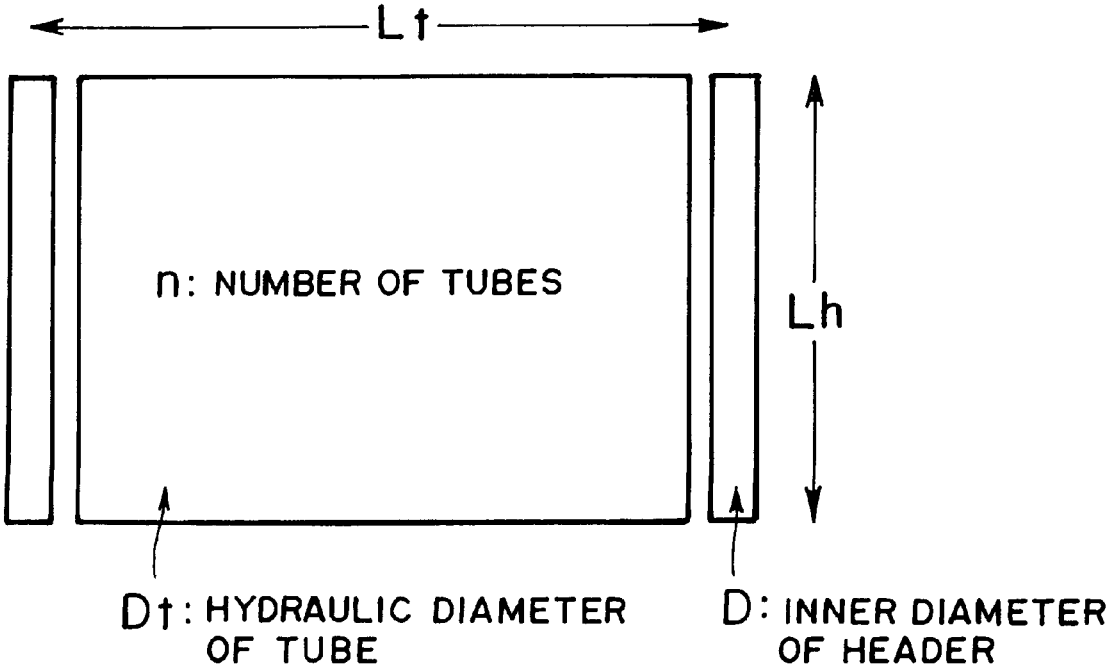
FIG. 5 is a schematic elevational view of the heat exchanger depicted in FIG. 1, labeling its dimensions.

Each heat transfer tube 4 of condenser 1 may be constituted as depicted in FIGS. 2–4.

In FIG. 2, heat transfer tube 4 comprises tube 11 (tube portion) and inner fin 12 which is inserted into tube 11. Inner fin 12 has paths which allow the heat exchange medium to flow substantially freely in the longitudinal and transverse directions of heat transfer tube 4, and in this embodiment, inner fin 12 is formed as depicted in FIG. 3. In FIG. 3, the direction of arrow 13 identifies a flow direction of refrigerant and the longitudinal direction of tube 11.

Many raised portions 14 and depressed portions 15 are formed in inner fin 12. These raised portions 14 and depressed portions 15 are formed by slotting and bending a flat plate. In this bending, for example, roll bending processing may be employed as in the formation of corrugated fins 5.

In inner fin 12, a plurality of waving strips 18, each having a raised portion 14, a first flat portion 16, a depressed portion 15, and a second flat portion 17 (depicted in FIG. 4) formed repeatedly in this order, are arranged adjacent to each other. In adjacent waving strips 18, first flat portion 16 of one waving strip 18 and second flat portion 17 of the other waving strip 16 adjacent to the one waving strip are disposed to form a continuous flat portion. Therefore, as viewed along the transverse direction of tube 11, each of first flat portions 16 and second flat portions 17 forms a straight and continuous flat portion, and raised portions 14 and depressed portions 15 are arranged alternately and adjacent to each other. Each slotting portion for forming each raised portion 14 or each depressed portion 15 forms a communication hole 19 placing opposite surface sides of inner fin 12 in communication.

In heat transfer tube 4 with such an inner fin 12, refrigerant flowing in the longitudinal direction in tube 11, as shown by arrows in FIG. 3, is distributed in right and left directions at each raised portion 14. The distributed refrigerant may flow freely along both surface sides of inner fin 12 through communication holes 19. Further, a part of the distributed refrigerant may flow directly along second flat portion 17 and reaches the next raised portion 14 of adjacent waving strip 18. On the reverse surface of inner fin 12, depressed portion 15 functions similarly to raised portion 14, and a similar distributed flow may be generated. Because a plurality of raised portions 14 and depressed portions 15 are arranged adjacent to and offset from each other, the above-described distributed flow may repeat patterns of distribution and joining. Therefore, refrigerant flowing in tube 11 flows while being mixed substantially continuously, and the refrigerant may be mixed more uniformly in the transverse direction of tube 11, i.e., in the air passing direction. At the same time, because first flat portions 16 and second flat portions 17 function to redirect the flow of refrigerant, mixing and redirecting may be repeated minutely. As a result, the heat transfer in the transverse direction of tube 11 may be performed more uniformly, and the heat exchange performance may be more uniform. Moreover, the heat exchange performance of the whole of heat transfer tubes 4, and ultimately, of the whole of condenser 1, may increase.

Referring again to FIG. 3, although the direction shown by arrow 13 is chosen as the refrigerant flowing direction and the longitudinal direction of tube 11, a direction shown by arrow 21 may be chosen as the refrigerant flowing direction and the longitudinal direction of tube 11. Also in this configuration, because raised portions 14 and depressed portions 15 are arranged alternately in the refrigerant flow direction, and the refrigerant is mixed more uniformly by means of flat portions 16 and 17 and communication holes 19, superior heat exchange performance may be achieved similarly to in the above-described embodiment.

In this embodiment, tubes 11 each inserted with inner fin 12 having the above-described superior heat exchange performance are disposed so as to form only one refrigerant flow path (one path directed from header 2 to header 3). Because only one path is formed, there is no turning portion. Even if heat transfer tubes 4 are formed by tubes 11 each inserted with inner fin 12, the entire core portion arranged with tubes 11 may have a relatively small pressure loss. However, because inner fin 12 formed as described above is inserted into each tube 11, each tube 11 may have a significant resistance relative to the pressure in entrance side header 2. Moreover, because each tube 11 exhibits the superior heat exchange performance as described above, the efficiency for heat exchange as the whole may be maintained at a high level. Further, because there is no flow turning portion, it is not necessary to split tube groups before and after the turning portion, and it is not necessary to address the problems accompanying the reduction of volume in forward flowing refrigerant, and a high efficiency for heat exchange may be maintained even if the flow rate of refrigerant varies.

Further, in the present invention, a flow division parameter $\gamma$ defined as a ratio of a resistance parameter $\beta$ of heat transfer tubes 4 to a resistance parameter $\alpha$ of entrance side header 2 is set to be at least about 0.5.

The flow division parameter is calculated, such that $$\gamma=\beta/\alpha,$$

where $$\beta=Lt/(Dt\cdot n),$$

and $$\alpha=Lh/Dh;$$

and where the equation variables are defined as follows:

Lt: length of tube 4,

Dt: hydraulic diameter of one tube 4, n: number of tubes 4,

Lh: length of entrance side header 2, and

Dh: hydraulic diameter of entrance side header 2.

Figure 6:
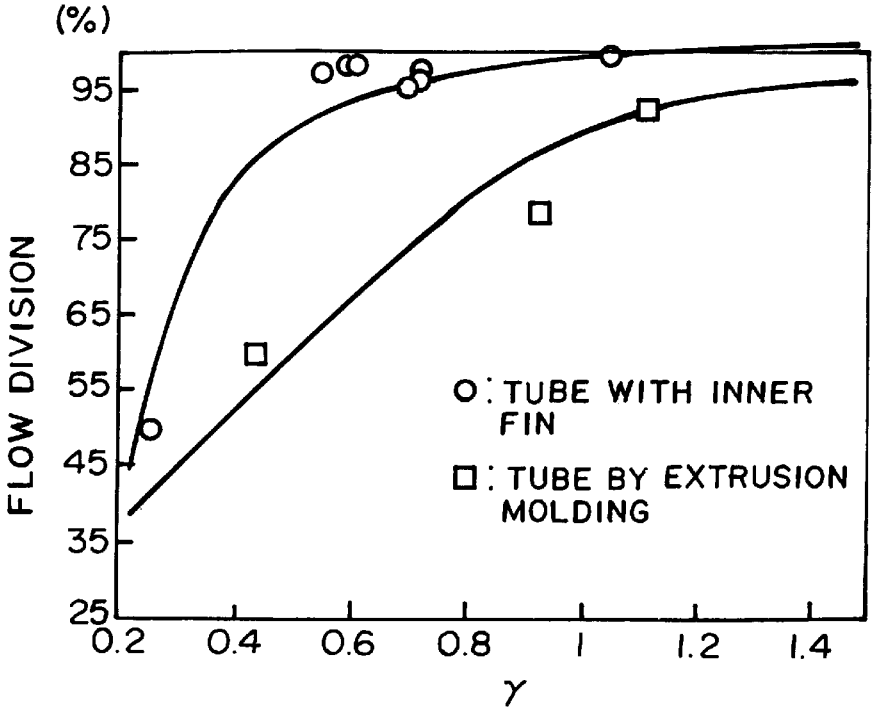
FIG. 6 is a graph showing relationships between a parameter $\gamma$ and an effective heat exchange area (flow division) obtained from the experimental data.

The respective dimensions are shown in FIG. 6.

The effects of changing the respective dimensions have been studied, and the results of this study are summarized in Table 1. In this study, tubes formed by extrusion molding, each having therein a plurality of small paths extending in the longitudinal direction of the tube and separated from each other, as well as tubes with inner fin 12, as depicted in FIG. 3, have been examined. Examination Nos. 1–9 relate to a heat exchanger having tubes with inner fin 12, as depicted in FIG. 3, and Examination Nos. 10–12 relate to a heat exchanger having tubes formed by extrusion molding. The flow division in each examination was evaluated by using an infrared temperature meter to determine how a heat exchange medium (refrigerant) flows effectively in the heat exchanger, and it was quantified by applying a ratio of the area of the effective flow to the entire area of the core portion of the heat exchanger. 75% or more is determined to be "good", 90% or more is determined to be "very good", and less than 75% is determined to be "not good". The results of the examination are set forth in Table 1 and FIG. 6.

As demonstrated by Table 1 and FIG. 6, in the configuration in which tubes with inner fin 12 depicted in FIG. 3 were used, very good results were obtained when the values of flow division parameter $\gamma$ were at least about 0.5. In the configuration in which tubes formed by extrusion molding were used, good results were obtained when the values of flow division parameter $\gamma$ were at least about 0.9, and particularly, a very good results were obtained when the values of flow division parameter $\gamma$ were at least about 1.0. On the other hand, when values of flow division parameter $\gamma$ were less than about 0.5, good results were not obtained.

TABLE 1

| | | Flow division (%) | | |
|---|---|---|---|---|
| Exam. No. | $\gamma$ | Tube with inner fin depicted in FIG. 3 | Tube with parallel paths formed by extrusion molding | Evaluation of flow division |
| 1 | 0.62 | 99 | — | very good |
| 2 | 0.6 | 98 | — | very good |
| 3 | 0.55 | 97 | — | very good |
| 4 | 0.61 | 98 | — | very good |
| 5 | 0.26 | 50 | — | not good |
| 6 | 1.05 | 99 | — | very good |
| 7 | 0.72 | 97 | — | very good |

TABLE 1-continued

| Exam. No. | γ | Flow division (%) Tube with inner fin depicted in FIG. 3 | Tube with parallel paths formed by extrusion molding | Evaluation of flow division |
|---|---|---|---|---|
| 8 | 0.72 | 96 | — | very good |
| 9 | 0.7 | 95 | — | very good |
| 10 | 0.44 | — | 60 | not good |
| 11 | 1.12 | — | 92 | very good |
| 12 | 0.93 | — | 79 | good |

In the above-described examination, although, in the conditions achieving a good flow division, the positions of inlet pipe 7 and outlet pipe 8 were varied to positions other than the end portions of headers 2 and 3, and including the longitudinally central portions of headers 2 and 3, so that refrigerant may flow more uniformly into the respective tubes at any of pipe positions.

Further, although the insertion depth of the tube end into the header was varied between a middle position, a position inside the middle position (tube side position), and a position outside the middle position, good results were obtained at any tube insertion depth, as long as the flow division parameter γ was within the range defined by the present invention. When the flow division parameter γ was below than the broadest range defined by the present invention, a good result was not obtained regardless the tube insertion position chosen.

In the present invention, although the upper limit of the parameter γ is not particularly restricted, as understood clearly from the examination resulted data, by practical design, this upper limit may be set at about 1.5.

Thus, the flow resistance of one tube may be set relatively high by reducing the hydraulic diameter of the path for refrigerant of the tube or by increasing the length of the tube, large amounts of refrigerant may be prevented from flowing into the tubes connected to the header at its refrigerant inlet which is the portion having the highest pressure, and refrigerant may be maintained more uniformly in the header. As a result, the refrigerant pressure in the header may be made more uniform, and the pressure applied to the respective tubes also may be made more uniform to achieve a good flow division. Namely, the flow division of refrigerant may be determined by the relationship between the flow resistance in the tubes and the pressure distribution in the header, and when the pressure distribution in the header becomes more uniform, the pressure applied to the respective tubes also may become more uniform, and the flow division may improve.

The present invention may be applied to a multi-flow type heat exchanger or stacking type heat exchanger having two paths, except the above-described multi-flow type heat exchanger having only one path. In these cases, as long as the flow division parameters γ, γ1, and γ2 satisfy the ranges as specified by the present invention, good flow division may be obtained.

Figure 7:
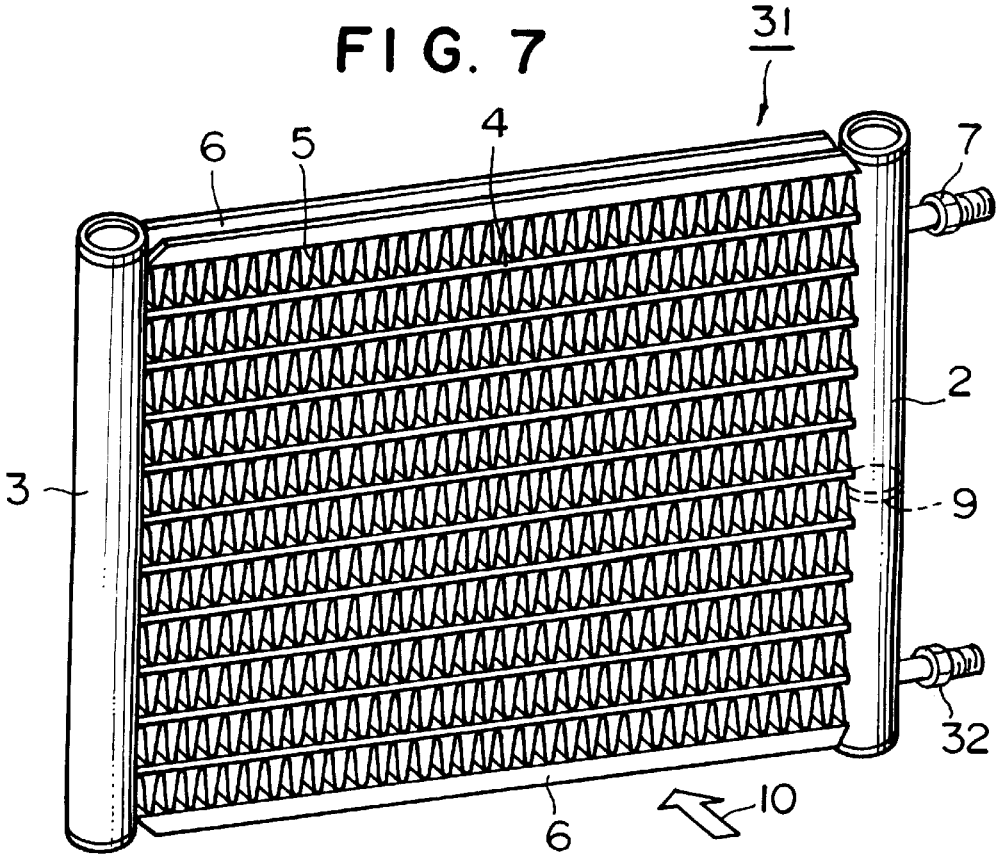
FIG. 7 is a perspective view of a heat exchanger according to a second embodiment of the present invention.

For example, FIG. 7 depicts a multi-flow type heat exchanger according to a second embodiment of the present invention, and the heat exchanger is formed as a condenser similarly to that described in the aforementioned first embodiment. In FIG. 7, condenser 31 has two flow paths for refrigerant, and is formed similarly to in the first embodiment, except for the change of structure consistent with achieving two paths. In particular, in condenser 31 depicted in FIG. 7, a partition 9 is provided in header 2 for dividing header 2 into a first part in direct communication with inlet pipe 7 and a second part in direct communication with outlet pipe 32. Refrigerant is introduced into the first part of header 2 through inlet pipe 7 flows toward header 3 through heat transfer tubes 4 connected to the first part of header 2. The flow of refrigerant is then turned in header 3, and refrigerant flows toward header 2 through the remaining heat transfer tubes 4 and into the second part of header 2. The refrigerant exits the heat exchanger through outlet pipe 32. The inner fin provided in each tube is formed as a similar structure to that depicted in FIG. 3.

In condensers having two flow paths for refrigerant, such as condenser 31, the superior heat exchange performance of tube 11 inserted with inner fin 12 may be achieved similarly to the manner described with respect to the first embodiment, the heat transfer performance of tube 11 itself may be ensured to be good, and the efficiency of heat exchange may be maintained at a high level with respect to the whole of condenser 31.

In condenser 31 having two flow paths for refrigerant, although the pressure loss may be slightly greater than that in the configuration with one path, it is much better as compared with the conventional structures having at least three flow paths, and it is possible to suppress the pressure loss over the entire core portion. Moreover, because the refrigerant flow direction is turned only once, it is enough to choose the number of the tubes divided between the respective tube groups before and after the flow turning at numbers schematically determined. Therefore, it is not necessary to be concerned with the problems originating from the reduction in the volume of refrigerant caused by changes in the rate of refrigerant flow, and a high efficiency of heat exchange may be maintained even if the flow rate of refrigerant changes.

In the multi-flow type condenser having two flow paths, the parameter γ1, preferably, also the flow division parameter γ2, may be at least about 0.5, thereby obtaining a good flow division. Although the upper limits of the flow division parameters γ1 and γ2 are not particularly restricted, as a matter of practical design, it is sufficient to set each upper limit at about 1.5.

Further, in the aforementioned heat exchanger having only one flow direction, or in the above-described heat exchanger having the first flow direction and the second flow direction, particularly, in a condenser, it is possible to provide a liquid tank and a supercooled portion integrally with the condenser or separatedly from the condenser at a position after the condenser, to form a so-called subcooling system.

In the present invention, by using the tube having the above-described inner fin with the waving strips and the flow division parameters γ, γ1, and γ2 within the target ranges, the performance of the entire tubes and, ultimately, of the entire heat exchanger may be increased. In the design of this inner fin with the waving strips, the respective portions of the inner fin is preferably designed so as to have optimum dimensions in order to achieve superior heat exchanger.

For example, hereinafter, the configuration of a particular condenser will be considered. The essential function of a condenser is to remove heat from a refrigeration cycle. However, as the practical basic function, it is necessary to have a pressure resistance within the condenser. Generally, in the refrigeration cycle using HFC134a refrigerant, a pressure resistance of at least about 10 MPa is required. Further, the flow resistance in the condenser is a significant factor when refrigerant flows. Further, in the refrigeration cycle using HFC134a refrigerant, if the flow resistance is great, there occurs an increase in the power of a compressor and a decrease of the heat radiation performance. Therefore, the flow resistance preferably is suppressed to less than about 100 kPa.

As typical dimensional parameters affecting the pressure resistance and the flow resistance in inner fin 12 described above, the following parameters exist: an elevation angle of raised portion 14 or depressed portion 15 relative to a flat portion located at the entrance side of the raised portion and/or the depressed portion in the flow direction of refrigerant (the elevation angle is depicted in FIG. 4 by "θ"); a thickness of inner fin 12; a height of inner fin 12 defined as a distance between a top of raised portion 14 and a bottom of depressed portion 15; a pitch from a top of raised portion 14 to a bottom of depressed portion 15; and a width of one waving strip 18. The relationships between the respective parameters and pressure resistance and flow resistance are shown in the graphs depicted in FIGS. 8–12.

Figure 8:
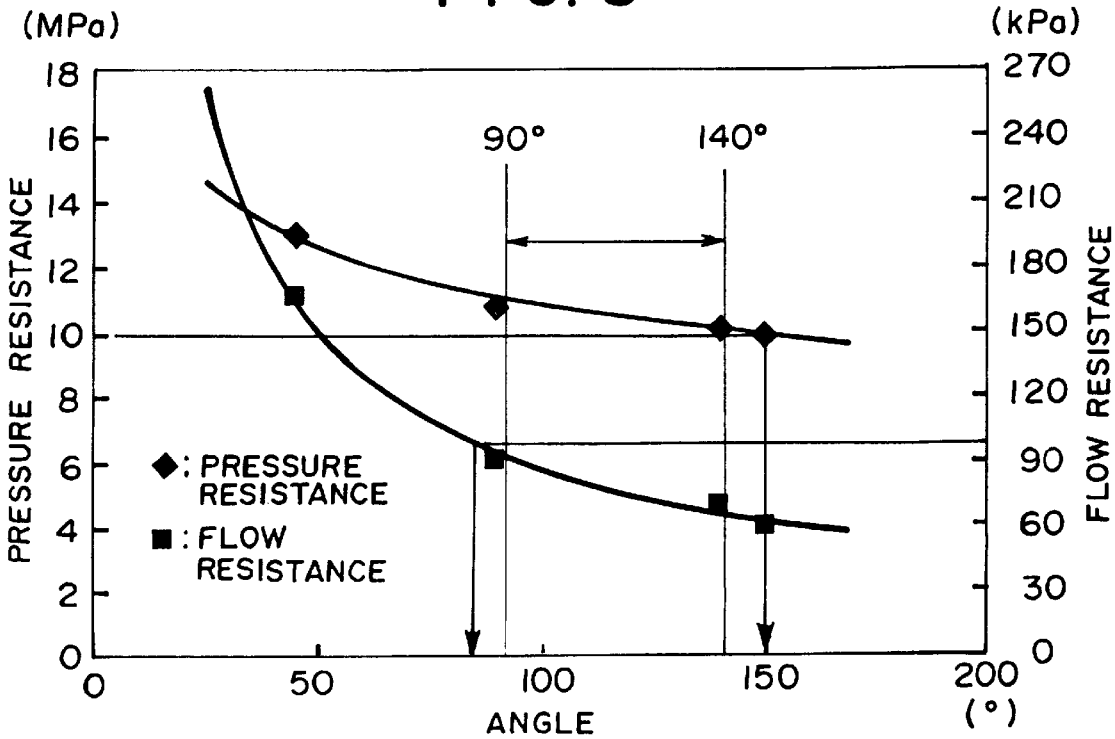
FIG. 8 is a graph depicting relationships between a raising angle of an inner fin and pressure resistance and flow resistance of the tube as depicted in FIG. 3.

As shown in FIG. 8, the elevation angle of raised portion 14 or depressed portion 15, or both, relative to a flat portion located at the entrance side of the raised portion or the depressed portion, or both, in the flow direction of refrigerant is preferably in the range of about 90° to about 150°, more preferably in the range of about 90° to about 140°. If the elevation angle is less than the above-described range, particularly, less than or equal to about 70°, the effect for interrupting the refrigerant flow becomes too great, and an undesirable increase of flow resistance occurs. If the elevation angle is more than the above-described range, particularly, at least about 160°, the strength decreases, and a desirable pressure resistance is not achieved.

Figure 9:
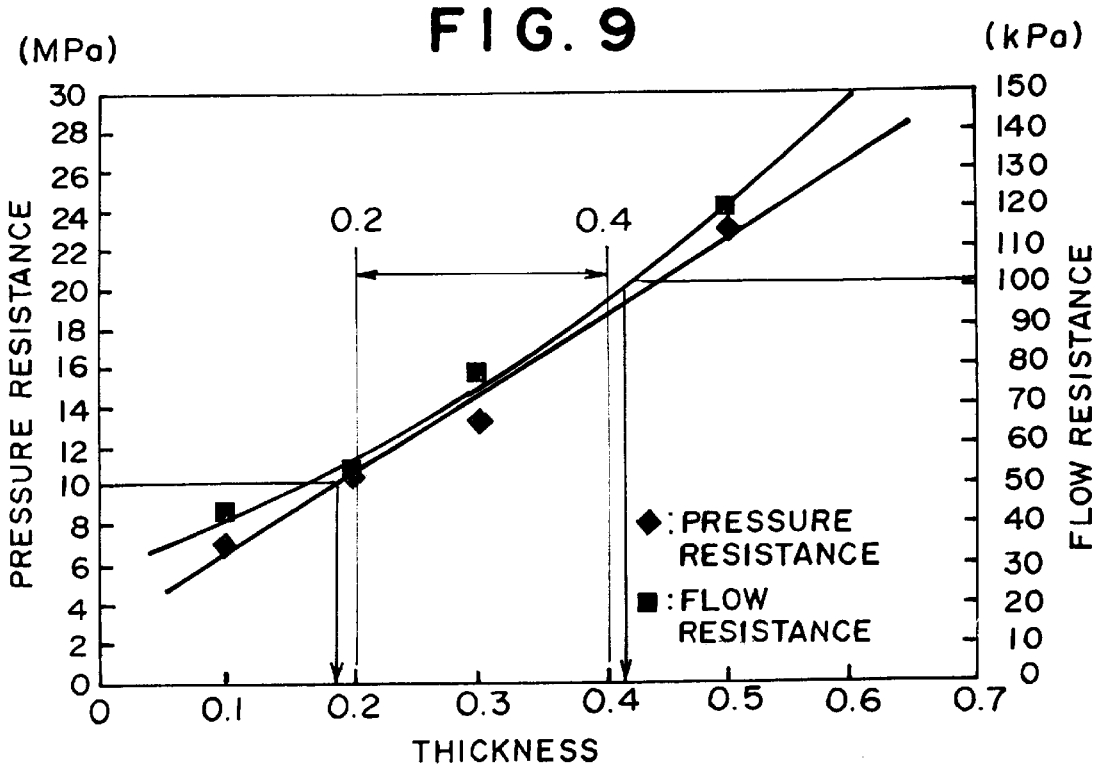
FIG. 9 is a graph depicting relationships between a thickness of an inner fin and pressure resistance and flow resistance of the tube as depicted in FIG. 3.

As shown in FIG. 9, the thickness of inner fin 12 is preferably in the range of about 0.1 to about 0.5 mm, and, more preferably in the range of about 0.2 to about 0.4 mm. If the thickness is less than about 0.1 mm, however, the pressure resistance may decrease. If the thickness is more than about 0.5 mm, the flow resistance may increase.

Figure 10:
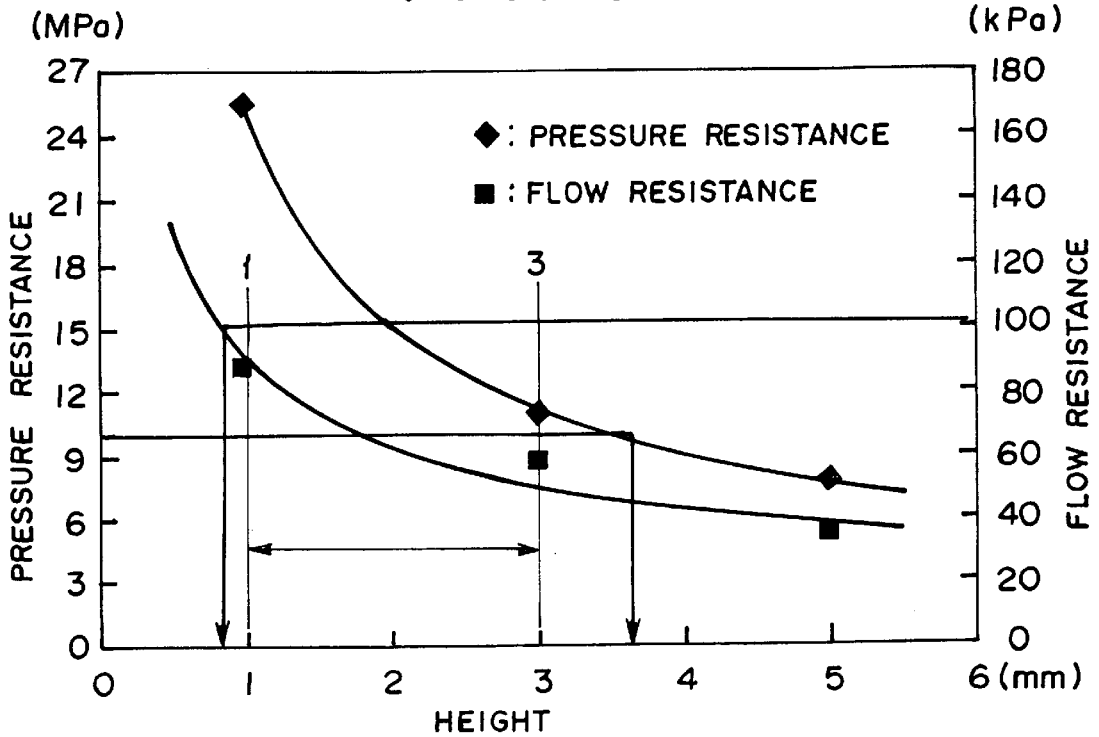
FIG. 10 is a graph depicting relationships between a height of an inner fin and pressure resistance and flow resistance of the tube as depicted in FIG. 3.

As shown in FIG. 10, the height of inner fin 12 defined as a distance between a top of raised portion 14 and a bottom of depressed portion 15 is preferably in the range of about 1 to about 5 mm, more preferably in the range of about 1 to about 3 mm. If the height of inner fin 12 is less than about 1 mm, the sectional area of the path in the tube becomes too small when inner fin 12 is brought into contact with the inner surface of the tube, and the flow resistance of refrigerant may become too great. If the height of inner fin 12 is more than about 5 mm, the pressure resistance may decrease.

Figure 11:
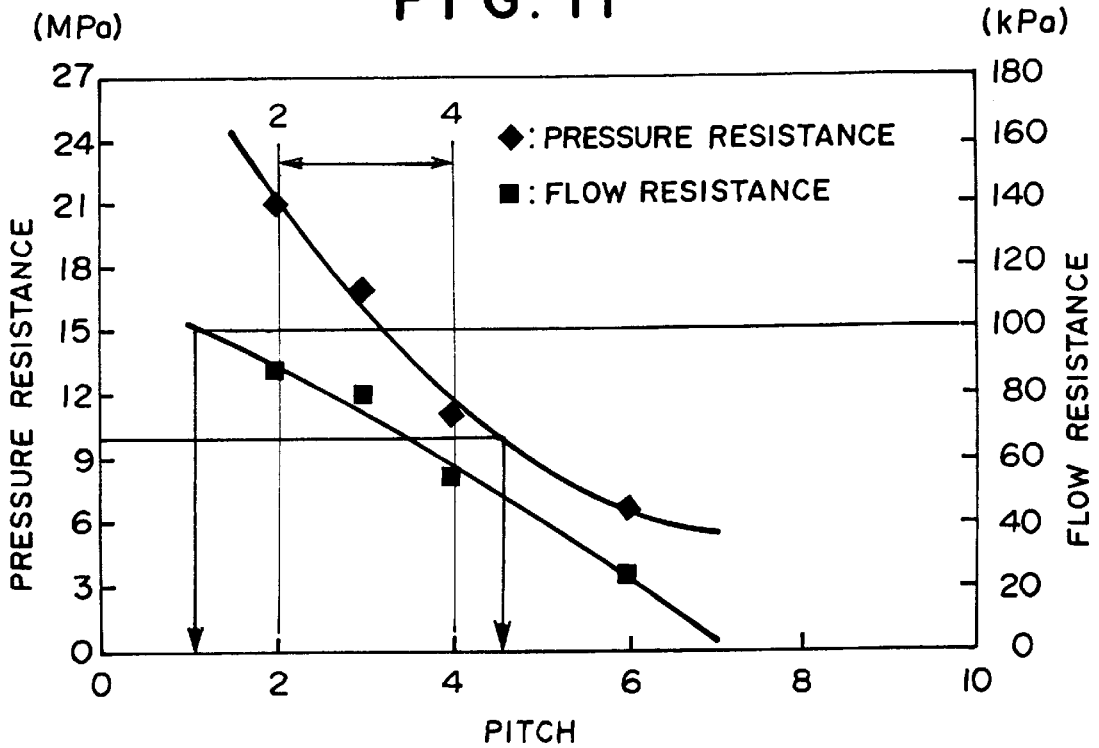
FIG. 11 is a graph depicting relationships between a pitch in an inner fin and pressure resistance and flow resistance of the tube as depicted in FIG. 3.

As shown in FIG. 11, the pitch from a top of raised portion 14 to a bottom of depressed portion 15 is preferably in the range of about 1 to about 6 mm, more preferably in the range of about 2 to about 4 mm. If the pitch is less than about 1 mm, the flow resistance may increase. If the pitch is more than about 6 mm, the pressure resistance may decrease.

Figure 12:
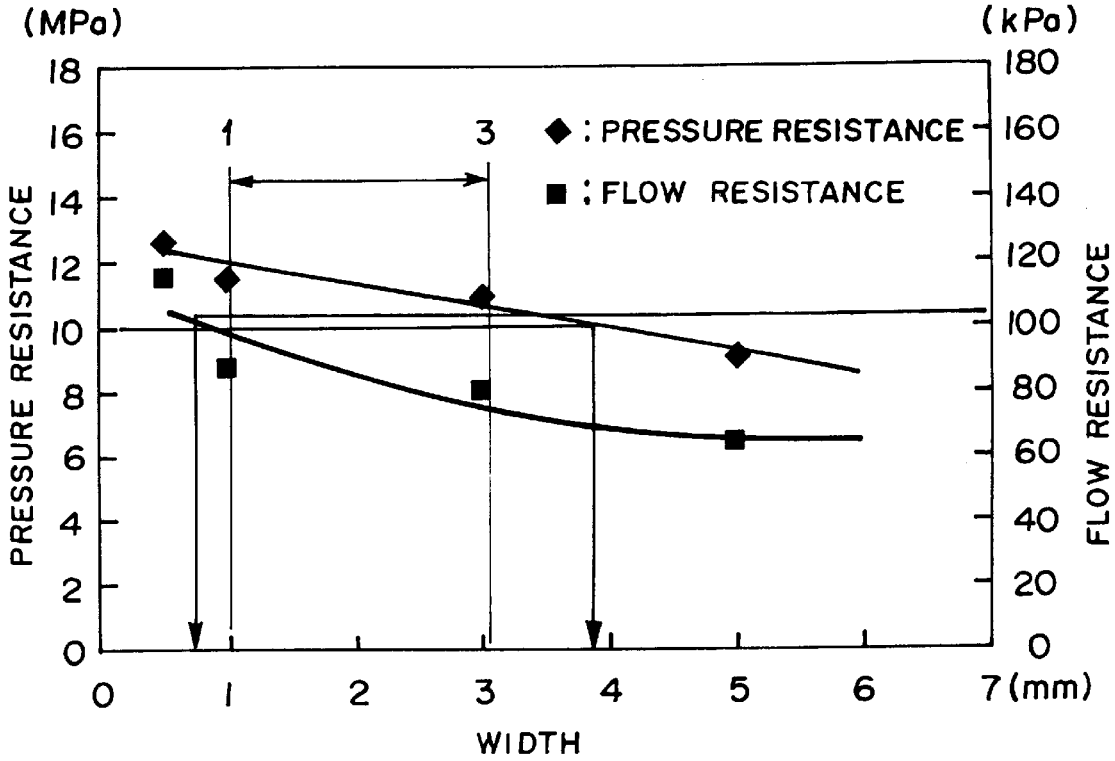
FIG. 12 is a graph depicting relationships between a width of a waving strip in an inner fin and pressure resistance and flow resistance of the tube as depicted in FIG. 3.

As shown in FIG. 12, the width of one waving strip 18 (width of adjacent slots for making raised portion 14 and depressed portion 15) is preferably in the range of about 0.5 to about 5 mm, more preferably in the range of about 1 to about 3 mm. If the width is less than about 0.5 mm, the processing ability of inner fin 12 may deteriorate. If the width is more than about 5 mm, the effect for interrupting the refrigerant flow becomes too great, and an undesirable increase of flow resistance occurs.

By setting the respective dimensions within the above-described optimum ranges in consideration of the properties of refrigerant, the refrigerant flow may be a three-dimensional turbulent flow to mix the refrigerant at a good condition, and the heat transfer performance of refrigerant side may increase. Further, the respective tubes 11 may have a sufficiently high pressure resistance and a sufficiently low flow resistance. At the same time, by providing such an inner fin 12, the area for heat transfer may be increased relative to that of a generally used tube formed by extrusion molding. By the multiplier effect of these improved properties, the performance of the entire tubes, and, ultimately, of the entire heat exchanger (condenser) may increase.

Thus, by using heat transfer tubes each having an inner fin which has waving strips which have raised portions, first flat portions, depressed portions, and second flat portions and are arranged in a specified positional relationship, a heat exchange medium flowing in the tube may be mixed more uniformly, the heat transfer may be performed more uniformly, and the heat exchange performance of the entire tubes, and, ultimately, of the entire heat exchanger, may be increased. Further, the inner fin according to the present invention may be easily manufactured by roll bending similar to the manufacture of corrugated fins. Further, by setting the dimensions of the respective portions of the inner fin within the optimum ranges, the performance of the entire tubes, and, ultimately, of the entire heat exchanger, may be further increased.

In the present invention, the structure, in which a plurality of paths are formed, so that the paths allow heat exchange medium to flow substantially freely in the longitudinal and transverse directions, may be formed by protruded portions provided on an inner surface of a tube.

Figure 13:
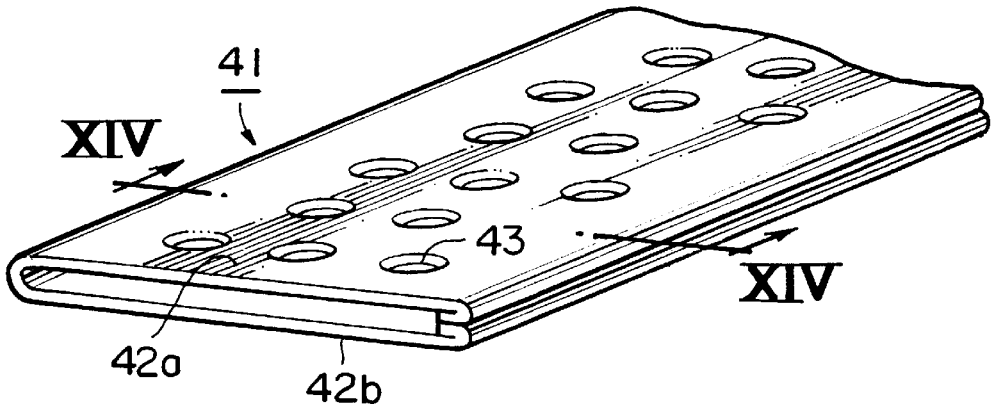
FIG. 13 is a partial, perspective view of a heat transfer tube of a heat exchanger according to a third embodiment of the present invention.
Figure 14:
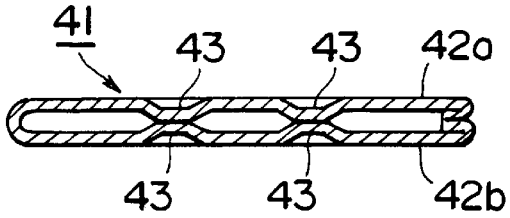
FIG. 14 is a cross-sectional view of the tube depicted in FIG. 13, as viewed along XIV—XIV line of FIG. 13.

For example, as depicted in FIGS. 13 and 14, protruded portions 43 protruding toward the inside of tube 41 are provided on the inner surfaces of opposing tube walls 42*a* and 42*b*. Protruded portions 43 may be formed by embossing walls 42*a* and 42*b* of tube 41. Protruded portions 43 are abutted or connected to each other at their top surfaces. Pairs of protruded portions 43 thus abutted or connected may be disposed at a staggered arrangement, as depicted in FIG. 8. Although protruded portions 43 are provided on both walls 42*a* and 42*b* in this embodiment, they may be provided on one wall and the protruded portions may be projected to a position on the inner surface of the opposing tube wall.

In such a tube structure, similar to that described with respect to the first embodiment, the relationship in pressure between the tubes and a header is set, so that flow division parameter γ may be at least about 0.5. Refrigerant flows in each tube 41 so as to bypass each protruded portion 43, and the temperature distribution in tube 41 may thereby be made more uniform. At the same time, by setting the flow division parameter γ at a value of at least about 0.5, refrigerant is divided from a header into a plurality of tubes 41, thereby achieving a superior heat exchange performance over the entire heat exchanger.

Although the above-described embodiments have been explained with respect to condensers, the present invention may be applied to other heat exchangers, in particular, to evaporators. In other heat exchangers, a desirable flow division may be achieved by setting the relationship in pressure between an entrance side header and heat transfer tubes connected thereto, so that the flow division parameter γ satisfies the above-described range.

As described hereinabove, in the heat exchanger according to the present invention, by setting the value of the parameter γ at at least about 0.5, the flow path of refrigerant may be made to be one path flow or two path flow by removing a partition or by reducing the number of partitions to the minimum number, i.e., one. Consequently, difficult processing or assembly may be unnecessary, as well as the flow division state may be set at an optimum state, thereby achieving a heat exchanger exhibiting superior heat exchange performance. Further, because the flow division improves, and the effective heat transfer area increases, a heat exchanger, which may be applied to any type vehicle and to any location in the vehicle, may be obtained.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A multi-flow type heat exchanger comprising a pair of headers, and a plurality of heat transfer tubes interconnecting said pair of headers, and in which a flow direction of a heat exchange medium through said plurality of heat transfer tubes is only in one direction, wherein said headers and said tubes are formed, such that a flow division parameter $\gamma$ is defined as a ratio of a resistance parameter $\beta$ of said plurality of heat transfer tubes to a resistance parameter $\alpha$ of a header located on an entrance side of said heat exchanger, in a range of at least about 0.5;

and wherein said flow division parameter is calculated, such that $$\gamma=\beta/\alpha,$$

where $$\beta=Lt/(Dt\cdot n),$$

and $$\alpha=Lh/Dh;$$

and wherein equation variables are defined as follows:

Lt equals a length of each tube,

Dt equals a hydraulic diameter of one tube, n equals a number of tubes,

Lh equals a length of said header located on an the entrance side of said heat exchanger, and Dh equals a hydraulic diameter of said header located on the entrance side of said heat exchanger.

2. The heat exchanger of claim 1, wherein said flow division parameter $\gamma$ is in the range of about 0.5 to about 1.5.

3. The heat exchanger of claim 1, wherein a plurality of paths are formed in each of said plurality of heat transfer tubes, and said plurality of paths allow said heat exchange medium to flow substantially freely in a longitudinal and a transverse direction of each of said plurality of heat transfer tubes.

4. The heat exchanger of claim 3, wherein said plurality of paths are formed by an inner fin.

5. The heat exchanger of claim 4, wherein said inner fin comprises a plurality of waving strips, each having a repeated structure comprising a raised portion, a first flat portion, a depressed portion, and a second flat portion, formed in that order, wherein said strips are arranged adjacent to each other, and said first flat portion of one of said waving strips and said second flat portion of an adjacent one of said waving strips form a continuous flat portion.

6. The heat exchanger of claim 5, wherein said plurality of waving strips extend in the longitudinal direction along each of said plurality of heat transfer tubes, and said continuous flat portions extend in the transverse direction of each of said plurality of heat transfer tubes.

7. The heat exchanger of claim 5, wherein said plurality of waving strips extend in the transverse direction of each of said plurality of heat transfer tubes, and said continuous flat portions extend in the longitudinal direction of each of said plurality of heat transfer tubes.

8. The heat exchanger of claim 5, wherein said plurality of waving strips are formed by roll bending processing of a flat plate.

9. The heat exchanger of claim 5, wherein an elevation angle of said raised portion and said depressed portion relative to a flat portion located at the entrance side of said raised portion and said depressed portion in the flow direction of said heat exchange medium is in the range of about 90° to about 150°.

10. The heat exchanger of claim 9, wherein said elevation angle is in the range of about 90° to about 140°.

11. The heat exchanger of claim 5, wherein a thickness of said inner fin is in the range of about 0.1 to about 0.5 mm.

12. The heat exchanger of claim 11, wherein said thickness of said inner fin is in the range of about 0.2 to about 0.4 mm.

13. The heat exchanger of claim 5, wherein a height of said inner fin, defined as a distance between a top of said raised portion and a bottom of said depressed portion, is in the range of about 1 to about 5 mm.

14. The heat exchanger of claim 13, wherein said height of said inner fin is in the range of about 1 to about 3 mm.

15. The heat exchanger of claim 5, wherein a pitch from a top of said raised portion to a bottom of said depressed portion is in the range of about 1 to about 6 mm.

16. The heat exchanger of claim 15, wherein said pitch is in the range of about 2 to about 4 mm.

17. The heat exchanger of claim 5, wherein a width of one of said plurality of waving strips is in the range of about 0.5 to about 5 mm.

18. The heat exchanger of claim 17, wherein said width is in the range of about 1 to about 3 mm.

19. The heat exchanger of claim 3, wherein said plurality of paths are defined by protruded portions formed on an inner surface of each of said plurality of heat transfer tubes.

20. The heat exchanger of claim 19, wherein said protruded portions are formed by embossing a wall of each of said plurality of heat transfer tubes.

21. The heat exchanger of claim 1, wherein a plurality of paths are formed in each of said plurality of heat transfer tubes, so that said plurality of paths extend in a longitudinal direction of each tube, separatedly from each other, and said flow division parameter $\gamma$ is at least about 0.9.

22. The heat exchanger of claim 21, wherein said flow division parameter $\gamma$ is at least about 1.0.

23. The heat exchanger of claim 21, wherein each of said plurality of heat transfer tubes is formed by extrusion molding.

24. The heat exchanger of claim 1, wherein said heat exchange medium is refrigerant, and said heat exchanger is a condenser.

25. The heat exchanger of claim 1, wherein said heat exchange medium is refrigerant, and said heat exchanger is an evaporator.

26. A multi-flow type heat exchanger comprising a pair of headers, and a plurality of heat transfer tubes interconnecting said pair of headers, and in which two flow directions of a heat exchange medium are created through the whole of said plurality of heat transfer tubes, wherein a first direction is formed by a first part of said plurality of heat transfer tubes and a second direction is formed by a second part of said plurality of heat transfer tubes, and wherein said headers and said tubes are formed, such that a flow division parameter $\gamma 1$ is defined as a ratio of a resistance parameter $\beta 1$ of said first part of said plurality of heat transfer tubes to a resistance parameter $\alpha 1$ of a first header portion located on an entrance side of said heat exchanger relative to the heat transfer tubes carrying said heat exchange medium in said first direction, in a range of at least about 0.5;

and wherein said flow division parameter $\gamma 1$ is calculated, such that $$\gamma 1=\beta 1/\alpha 1,$$

where $$\beta 1=Lt/(Dt\cdot n1),$$

and $$\alpha 1=Lh1/Dh1;$$

and wherein equation variables are defined as follows:

Lt equals a length of each tube,

Dt equals a hydraulic diameter of one tube, n1 equals a number of tubes in which said heat exchange medium flows in said first direction, Lh1 equals a length of said first header portion, and Dh1 equals a hydraulic diameter of said first header portion.

27. The heat exchanger of claim 26, wherein a flow division parameter $\gamma 2$ defined as a ratio of a resistance parameter $\beta 2$ of said second part of said plurality of heat transfer tubes to a resistance parameter $\alpha 2$ of a second header portion located on the entrance side of said heat exchanger relative to said second part of said plurality of heat transfer tubes carrying said heat exchange medium in said second direction, is in a range of at least about 0.5;

and wherein said flow division parameter $\gamma 2$, is calculated, such that $$\gamma 2=\beta 2/\alpha 2,$$

where $$\beta 2=Lt/(Dt\cdot n2),$$

and $$\alpha 2=Lh2/Dh2;$$

and wherein equation variables are defined as follows:

Lt equals a length of each tube,

Dt equals a hydraulic diameter of one tube, n2 equals a number of tubes in which said heat exchange medium flows in said second direction, Lh2 equals a length of said second header portion, and Dh2 equals a hydraulic diameter of said second header portion.

28. The heat exchanger of claim 27, wherein at least one of said flow division parameters $\gamma 1$ and $\gamma 2$ is in the range of about 0.5 to about 1.5.

29. The heat exchanger of claim 26, wherein a plurality of paths are formed in each of said plurality of heat transfer tubes, and said plurality of paths allow said heat exchange medium to flow substantially freely in a longitudinal and a transverse direction of each of said plurality of heat transfer tubes.

30. The heat exchanger of claim 29, wherein said plurality of paths are formed by an inner fin.

31. The heat exchanger of claim 30, wherein said inner fin comprises a plurality of waving strips, each having a repeated structure comprising a raised portion, a first flat portion, a depressed portion, and a second flat portion, formed in that order, wherein said strips are arranged adjacent to each other, and said first flat portion of one of said waving strips and said second flat portion of an adjacent one of said waving strips form a continuous flat portion.

32. The heat exchanger of claim 31, wherein said plurality of waving strips extend in the longitudinal direction along each of said plurality of heat transfer tubes, and said continuous flat portions extend in the transverse direction of each of said plurality of heat transfer tubes.

33. The heat exchanger of claim 31, wherein said plurality of waving strips extend in the transverse direction of each of said plurality of heat transfer tubes, and said continuous flat portions extend in the longitudinal direction of each of said plurality of heat transfer tubes.

34. The heat exchanger of claim 31, wherein said plurality of waving strips are formed by roll bending processing of a flat plate.

35. The heat exchanger of claim 31, wherein an elevation angle of said raised portion and said depressed portion relative to a flat portion located at the entrance side of said raised portion and said depressed portion in the flow direction of said heat exchange medium is in the range of about 90° to about 150°.

36. The heat exchanger of claim 35, wherein said elevation angle is in the range of about 90° to about 140°.

37. The heat exchanger of claim 31, wherein a thickness of said inner fin is in the range of about 0.1 to about 0.5 mm.

38. The heat exchanger of claim 37, wherein said thickness of said inner fin is in the range of about 0.2 to about 0.4 mm.

39. The heat exchanger of claim 31, wherein a height of said inner fin, defined as a distance between a top of said raised portion and a bottom of said depressed portion, is in the range of about 1 to about 5 mm.

40. The heat exchanger of claim 39, wherein said height of said inner fin is in the range of about 1 to about 3 mm.

41. The heat exchanger of claim 31, wherein a pitch from a top of said raised portion to a bottom of said depressed portion is in the range of about 1 to about 6 mm.

42. The heat exchanger of claim 41, wherein said pitch is in the range of about 2 to about 4 mm.

43. The heat exchanger of claim 31, wherein a width of one of said plurality of waving strips is in the range of about 0.5 to about 5 mm.

44. The heat exchanger of claim 43, wherein said width is in the range of about 1 to about 3 mm.

45. The heat exchanger of claim 29, wherein said plurality of paths are defined by protruded portions formed on an inner surface of each of said plurality of heat transfer tubes.

46. The heat exchanger of claim 45, wherein said protruded portions are formed by embossing a wall of each of said plurality of heat transfer tubes.

47. The heat exchanger of claim 26, wherein a plurality of paths are formed in each of said plurality of heat transfer tubes, so that said plurality of paths extend in a longitudinal direction of each tube, separatedly from each other, and said flow division parameter $\gamma 1$ is at least about 0.9.

48. The heat exchanger of claim 47, wherein said flow division parameter $\gamma 1$ is at least about 1.0.

49. The heat exchanger of claim 47, wherein each of said plurality of heat transfer tubes is formed by extrusion molding.

50. The heat exchanger of claim 26, wherein said heat exchange medium is refrigerant, and said heat exchanger is a condenser.

51. The heat exchanger of claim 26, wherein said heat exchange medium is refrigerant, and said heat exchanger is an evaporator.

* * * * *